United States Patent [19]

Bartlett

[11] Patent Number: 5,013,271

[45] Date of Patent: May 7, 1991

[54] BUOYANT BODY SURFING SUIT

[76] Inventor: Thomas C. Bartlett, 1219 Keeaumoku St., #400, Honolulu, Hi. 96814

[21] Appl. No.: 564,340

[22] Filed: Aug. 8, 1990

[51] Int. Cl.[5] ..... A63C 15/02

[52] U.S. Cl. ..... 441/65; 441/106; 441/115; 441/102

[58] Field of Search ..... 441/88, 102, 103, 104, 441/105, 106, 108, 114, 115, 129, 65, 66

[56] References Cited

U.S. PATENT DOCUMENTS

| | | | |
|---|---|---|---|
| 128,971 | 7/1872 | Merriman | 441/104 |
| 1,082,643 | 12/1913 | Matthews | 441/104 |
| 2,197,228 | 4/1940 | Then | 441/102 |
| 2,374,506 | 4/1945 | Schorovsky | 441/102 |
| 3,335,441 | 8/1967 | Wolfe | 441/103 |
| 3,398,406 | 8/1968 | Waterbury | 441/103 |
| 3,803,652 | 4/1974 | Uyehara | 441/66 |

FOREIGN PATENT DOCUMENTS

| | | | |
|---|---|---|---|
| 2041300 | 9/1980 | United Kingdom | 441/103 |

OTHER PUBLICATIONS

Sailboard Warehouse, catalog 1988, pp. 42, 43, 44, 45, St. Paul, Minn.

*Primary Examiner*—Sherman Basinger
*Assistant Examiner*—Stephen P. Avila
*Attorney, Agent, or Firm*—Michael I. Kroll

[57] ABSTRACT

The present invention relates to a buoyant body surfing suit for a body surfer having knees. The buoyant body surfing suit includes an upper portion together with a pair of short sleeves, a collar, a front, and a rear being a homogeneous piece of resilient material, and a lower portion together with the upper portion and a front being a homogeneous piece of resilient material, the lower portion together with a pair of legs being a homogeneous piece of resilient material that ends below the knees of the body surfer so that due to the collar and the pair of short sleeves water is prevented from entering under the buoyant body surfing suit and slow down the speed of the body surfer.

2 Claims, 2 Drawing Sheets

Fig. 1
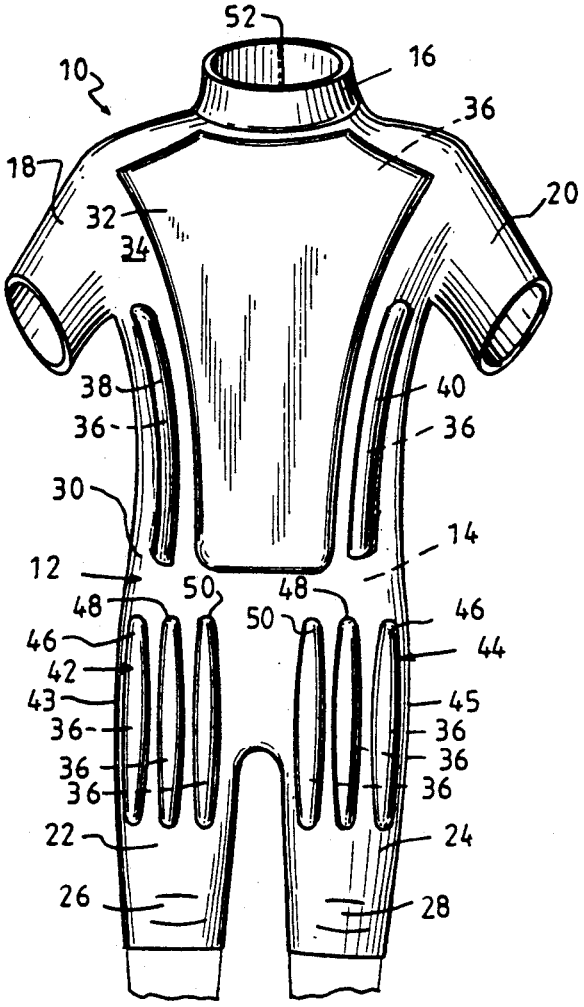
Fig. 2
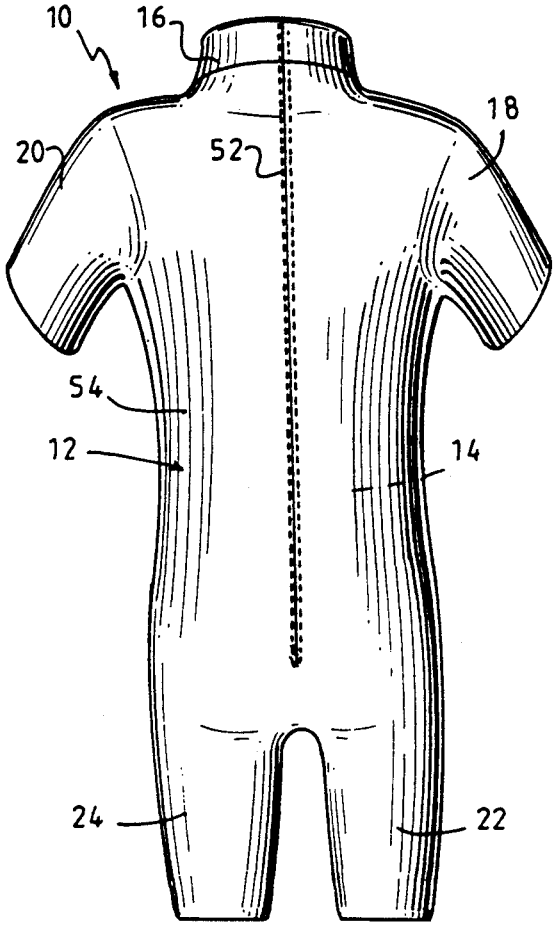
Fig. 3
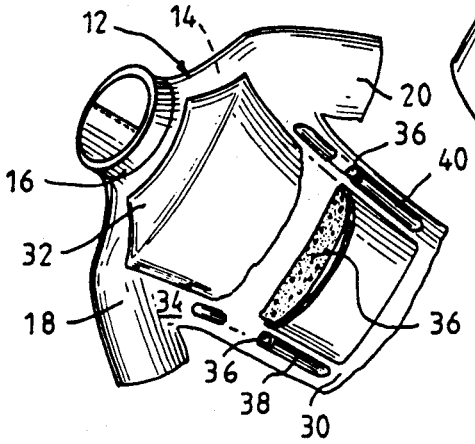
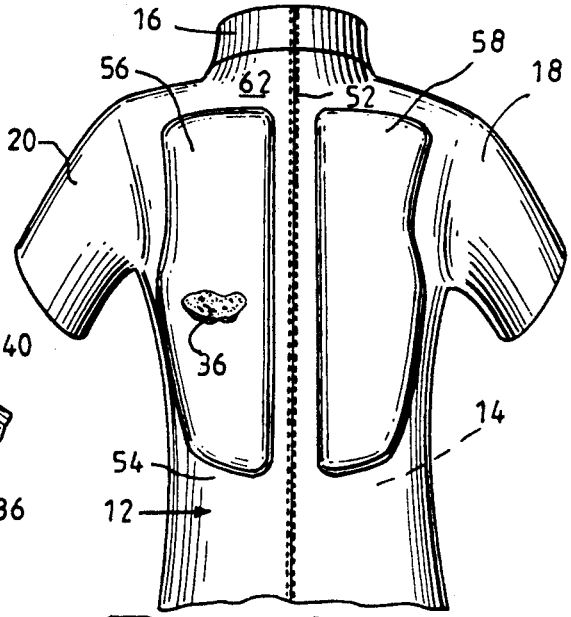
Fig. 4

Fig. 5
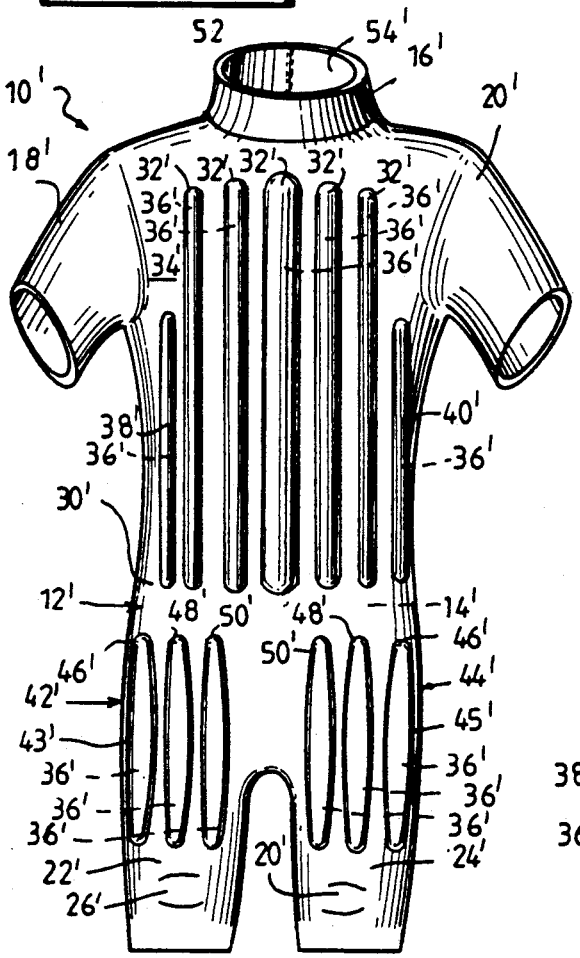
Fig. 6
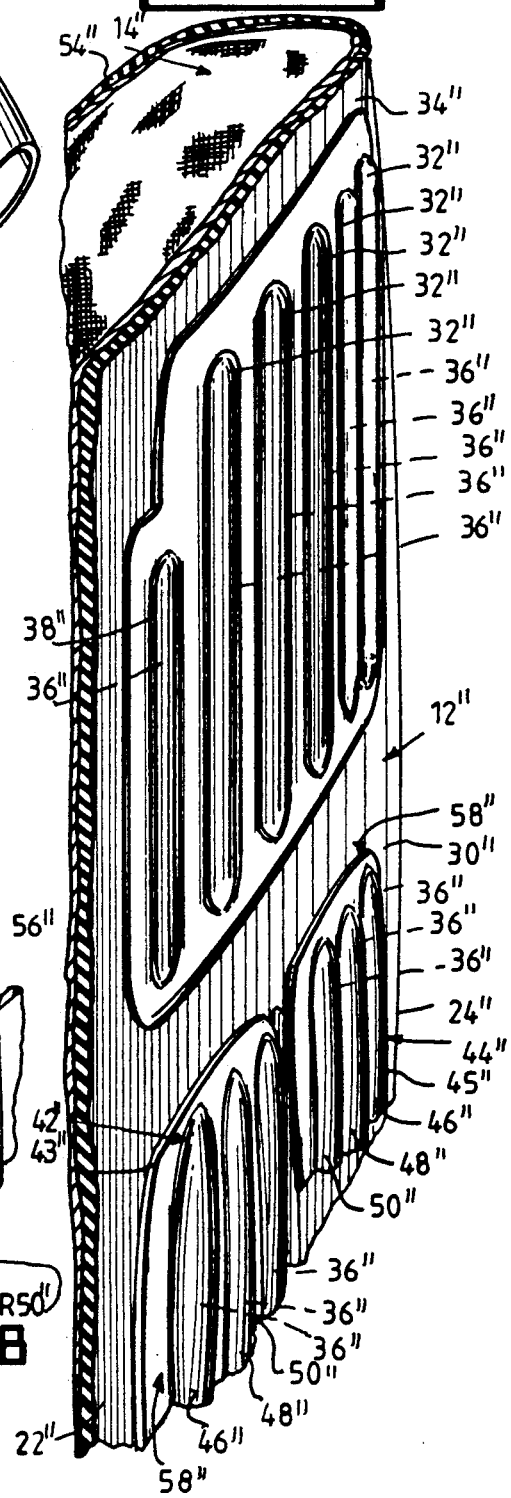
Fig. 7
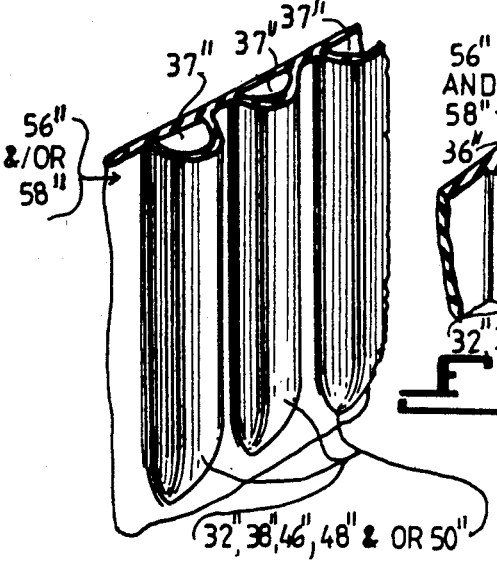
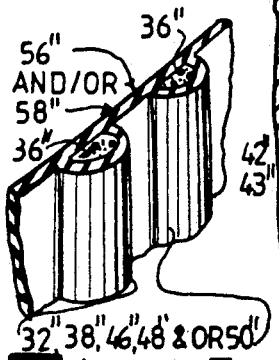
Fig. 8

BUOYANT BODY SURFING SUIT

BACKGROUND OF THE INVENTION

1. Field of the Invention

The present invention relates to a body surfing suit.

More particularly, the present invention relates to a buoyant body surfing suit that contains means for increasing the buoyancy of the body surfer.

2. Description of the Prior Art

Numerous innovations for body surfing suits have been provided in the prior art that are adapted to be used. Even though these innovations may be suitable for the specific individual purposes to which they address, they would not be suitable for the purposes of the present invention as heretofore described.

For example, U.S. Pat. No. 4,397,636 to Ganshaw teaches a long sleeve shirt with buoyant forearm pads. The buoyant forearm pads are located on the underneath part of the forearm. Additionally, the shirt clings to the body surfer's body only when it is wet. Since the shirt has long sleeves, elastic wrist cuffs are provided and used as seals. An elastic waist band is also provided and used as a seal.

SUMMARY OF THE INVENTION

Accordingly, it is an object of the present invention to provide a buoyant body surfing suit that avoids the disadvantages of the prior art.

More particularly, it is an object of the present invention to provide an air filled or floatation foam filled garment that increases the gross buoyancy of the human body so that the body surfer can skim across the water powered by only the wave energy.

Two types of suits are taught by the present invention. One is for surfing on large, long, and rolling waves, which are always further out from the shore and the other is for surfing on shorter and faster waves, which break close to shore.

In keeping with these objects, and with others which will become apparent hereinafter, one feature of the present invention resides, briefly stated, in a buoyant body surfing suit for a body surfer having knees, comprising, an upper portion together with a pair of short sleeves, a collar, a front, and a rear being a homogeneous piece of resilient material, and a lower portion together with the upper portion and a front being a homogeneous piece of resilient material, the lower portion together with a pair of legs being a homogeneous piece of resilient material that ends below the knees of the body surfer.

When the buoyant body surfing suit is designed in accordance with the present invention, due to the collar and the pair of short sleeves water is prevented from entering under the buoyant body surfing suit and slow down the speed of the body surfer.

In accordance with another feature of the present invention, the upper portion, the pair of short sleeves, the collar, the lower portion, and the pair of legs are one homogeneous piece of neoprene which has a very slick surface that reduces drag and contains a nylon liner for comfort.

Another feature of the present invention is that it further comprises a plurality of buoyancy increasing means disposed on the front of the upper portion and the lower portion of the buoyant body surfing suit.

Yet another feature of the present invention is that the plurality of buoyancy increasing means include a chest pad, a plurality of channels, and optional back pads, that are filled with a material taken from the group consisting of floatation foam and air.

Still another feature of the present invention is that it further comprises a zipper disposed on the rear of the buoyant body surfing suit so that a body surfer can quickly and easily put on and take off the buoyant body surfing suit.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a front perspective view of the buoyant body surfing suit of the present invention wherein the suit is used for body surfing on shorter and faster waves that break close to shore;

FIG. 2 is a rear perspective view of the buoyant body surfing suit of the present invention, shown in FIG. 1;

FIG. 3 is a front oriented perspective view of the upper portion of the buoyant body surfing suit of the present invention, shown in FIG. 1;

FIG. 4 is a rear perspective view of the buoyant body surfing suit of the present invention with the optional back pads being used for body surfing on the back;

FIG. 5 is a front perspective view of the first alternate embodiment of the buoyant body surfing suit of the present invention wherein the suit is used for body surfing on large, long, and rolling waves which are further out from shore.

FIG. 6 is a perspective view of the second alternate embodiment of the present invention wherein the channels are affixed to bases which are then attached to the buoyant body surfing suit of the present invention;

FIG. 7 is a cross-sectional perspective view of the channels of the buoyant body surfing suit of the present invention and which are filled with air; and FIG. 8 is a cross-sectional perspective view of the channels of the buoyant body surfing suit of the present invention and which are filled with floatation foam.

LIST OF REFERENCE NUMERALS UTILIZED IN THE DRAWING

10— buoyant body surfing suit of the present invention
12— slick surface 12
14— nylon liner
16— collar of the buoyant body surfing suit 10
18— short sleeve of the buoyant body surfing suit 10
20— short sleeve of the buoyant body surfing suit 10
22— leg of the buoyant body surfing suit 10
24— leg of the buoyant body surfing suit 10
26— knee of the buoyant body surfing suit 10
28— knee of the buoyant body surfing suit 10
30— front of the buoyant body surfing suit 10
32— chest pad of the buoyant body surfing suit 10
34— chest of the buoyant body surfing suit 10
36— floatation foam
38— channel
40— channel
42— thigh pad
43— thigh area of the buoyant body surfing suit 10

44— thigh pad
45— thigh area of the buoyant body surfing suit 10
46— channel
48— channel
50— channel
52— zipper of the buoyant body surfing suit 10
54— rear side of the buoyant body surfing suit 10
10'— buoyant body surfing suit of the present invention
12'— slick surface 12
14'— nylon liner
16'— collar of the buoyant body surfing suit 10'
18'— short sleeve of the buoyant body surfing suit 10'
20'— short sleeve of the buoyant body surfing suit 10'
22'— leg of the buoyant body surfing suit 10'
24'— leg of the buoyant body surfing suit 10'
26'— knee of the buoyant body surfing suit 10'
28'— knee of the buoyant body surfing suit 10'
30'— front of the buoyant body surfing suit 10'
32'— five channels of the buoyant body surfing suit 10'
34'— chest of the buoyant body surfing suit 10'
36'— floatation foam
38'— channel
40'— channel
42'— thigh pad
43'— thigh area of the buoyant body surfing suit 10'
44'— thigh pad
45'— thigh area of the buoyant body surfing suit 10'
46'— channel
48'— channel
50'— channel
52'— zipper of the buoyant body surfing suit 10'
54'— rear side of the buoyant body surfing suit 10'
10''— buoyant body surfing suit of the present invention
32''— channels of the buoyant body surfing suit 10'
38''— channel of the buoyant body surfing suit 10''
46''— channel
48''— channel
50''— channel
52''— zipper of the buoyant body surfing suit 10'
54''— rear side of the buoyant body surfing suit 10'
56''— base
58''— base

DETAILED DESCRIPTION OF THE PREFERRED EMBODIMENT

Referring now to FIGS. 1 through 3, the buoyant body surfing suit 10 of the present invention is shown in the configuration for use on shorter and faster waves that break close to the shore.

The buoyant body surfing suit 10 is made of neoprene which has a very slick surface 12 for reducing drag, and a nylon liner 14 for comfort.

The neoprene material, of which the buoyant body surfing suit 10 is made from, adds to the buoyancy of the buoyant body surfing suit 10. Depending on the neoprene thickness, a body surfer could body surf in colder, East Coast water, for longer periods of time, since the neoprene suit 10 keeps the body temperature elevated. Since the buoyant body surfing suit 10 has glued and stitched seams, it is impossible for water to enter the buoyant body surfing suit 10.

The buoyant body surfing suit 10 consists basically of a collar 16, a pair of short sleeves 18 and 20, and a pair of legs 22 and 24 that end below the knees 26 and 28.

The buoyant body surfing suit 10 requires the use of the collar 16 and the pair of short sleeves 18 and 20 so that water is prevented from entering under the buoyant body surfing suit 10 and cause the speed of the surfer to be lowered.

A plurality of buoyancy increasing means are disposed on the front 30 of the buoyant body surfing suit 10, as can best be seen in FIG. 1.

A chest pad 32 is disposed on the chest 34 of the buoyant body surfing suit 10 and which is filled with a floatation foam 36. On either side of the chest pad 32, are disposed one of a pair of channels 38 and 40 which are filled with the floatation foam 36 and which can best be seen in FIG. 3.

Thigh pads 42 and 44, as shown in FIG. 1, are disposed on the front thigh areas 43 and 45 of the buoyant body surfing suit 10. Each of the thigh pads 42 and 44 contain three channels 46, 48, and 50, and with each channel being filled with the floatation foam 36.

The rear side 54 of the buoyant body surfing suit 10, as shown in FIG. 2, contains a zipper 52 which aids in the putting on and the taking off of the buoyant body surfing suit 10.

The floatation foam 36 is made of enselite that is approximately 1" thick.

Referring now to FIG. 5, an alternate embodiment of the buoyant body surfing suit 10' of the present invention is shown in the configuration for use on large, long and rolling waves which are further out from shore.

The buoyant body surfing suit 10' is also made of neoprene and which also has a very slick surface 12' for reducing drag, and a nylon liner 14' for comfort.

The neoprene material, of which the buoyant body surfing suit 10' is made from, adds to the buoyancy of the suit 10'. Depending on the neoprene thickness, a body surfer could body surf in colder, East Coast water, for longer periods of time, since the neoprene suit 10' keeps the body temperature elevated. Since the buoyant body surfing suit 10' has glued and stitched seams, it is impossible for water to enter the buoyant body surfing suit 10'.

The buoyant body surfing suit 10' consists basically of a collar 16', a pair of short sleeves 18' and 20', and a pair of legs 22' and 24' that end below the knees 26' and 28'.

The buoyant body surfing suit 10' requires the use of the collar 16' and the pair of short sleeves 18' and 20' so that water is prevented from entering under the buoyant body surfing suit 10' and cause the speed of the surfer to be lowered.

A plurality of buoyancy increasing means are disposed on the front 30' of the buoyant body surfing suit 10', as can best be seen in FIG. 5.

Five channels 32, are disposed on the chest 34' of the buoyant body surfing suit 10' and which are filled with a floatation foam 36'. On either side of the five channel 32', are disposed each of a pair of shorter channels 38' and 40' which are filled with the floatation foam 36', and which can best be seen in FIG. 5.

Thigh pads 42' and 44', as shown in FIG. 5, are disposed on the front thigh areas 43' and 45' of the buoyant body surfing suit 10'. Each of the thigh pads 42' and 44' contain three channels 46', 48', and 50', and with each channel filled with the floatation foam 36'.

The rear side 54' of the buoyant body surfing suit 10', as shown in FIG. 5, contains a zipper 52' which aids in the putting on and the taking off of the buoyant body surfing suit 10'.

The floatation foam 36', like 36, is also made of enselite that is also approximately 1" thick.

Also shown in FIGS. 6 through 8, another alternate embodiment of the present invention is applicable to the buoyant body surfing suit 10'. In this embodiment, the channels 32", 38", 46", 48", and 50" are filled with either floatation foam 36" or air 37".

As can best be seen in FIGS. 7 and 8, the channels 32" and 38" are one homogeneous piece of material with the base 56" and the channels 46", 48", and 50" as one homogeneous piece of material with each of the pair of bases 58" so that the bases 56" and 58" are attached to the buoyant body surfing suit 10', as can best be seen in FIG. 6, instead of the channels 32", 38", 46", 48", and 50" being attached directly to the buoyant body surfing suit 10'.

Optionally used back pads 56 and 58, also contain the floatation foam 36 and as shown in FIG. 4, the back pads 56 and 58 are disposed on the upper rear portion 62 of the buoyant body surfing suit 10 or 10'. The back pads 56 and 58 permit a body surfer to surf on the back.

The buoyant body surfing suit has sufficient buoyancy so that the body surfer does not have to make a major physical effort to stay afloat, especially between waves. The body surfer merely floats on the back or in an upright position, and remains relaxed while waiting for each wave. The body surfer using the present invention does not tire as quickly, and can last in the water for long periods of time.

The buoyant body surfing suit can also function as a life vest. If a body surfer becomes unconscious, after being pounded by a wave, the surfer is automatically set afloat on his back, face up. This occurs because the majority of the buoyancy material is on the front of the suit.

On the suit for body surfing on long slow rolling offshore waves, long channels are used to cut into the wave for speed and control. Additionally, three channels are disposed on each of the thighs, for rudder control. These same rudders are also used on the suit that is used for waves that are closer to shore.

It is to be noted that the suit is not so buoyant that a body surfer can not dive under a wave with great ease. With the pads on the back of the buoyant body surfing suit, the body surfer will be able to surf on the back.

It will be understood that each of the elements described above, or two or more together, may also find a useful application in other types of constructions differing from the type described above.

While the invention has been illustrated and described as embodied in a buoyant body surfing suit, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A buoyant body surfing suit for a body surfer having knees, comprising:

(a) an upper portion including a pair of short sleeves, a collar, a front, and a rear;

(b) a lower portion including a front and a pair of legs said pair of legs, ending below the knees of the body surfer so that due to said collar and said pair of short sleeves water is prevented from entering under the buoyant body surfing suit and slow down the speed of the body surfer, said upper portion, said pair of short sleeves, said collar, said lower portion, and said pair of legs are one homogeneous piece of neoprene which has a very slick surface that reduces drag and contains a nylon liner for comfort;

(c) a plurality of buoyancy increasing means disposed on said front of said upper portion, said rear of said upper portion and said front of said lower portion of the buoyant body surfing suit, said plurality of buoyancy increasing means include a buoyant chest pad shaped to be widest at the shoulders and tapering to the waist with a plurality of buoyant substantially channel shaped pads disposed therewith, a plurality of buoyant substantially channel shaped pads disposed on said front of said pair of legs of said lower portion, and a plurality of buoyant back pads disposed on said back of said upper portion, said buoyant chest pad with said plurality of buoyant substantially channel shaped pads disposed therewith, said plurality of buoyant substantially channel shaped pads disposed on said front of said pair of legs, and said plurality of buoyant back pads being filled with a floatation foam material.

2. A suit as defined in claim 1; further comprising a zipper disposed on said rear of the buoyant body surfing suit so that a body surfer can quickly and easily put on and take off the buoyant body surfing suit.

* * * * *